US005281150A

United States Patent [19]

Bundga et al.

[11] Patent Number: 5,281,150

[45] Date of Patent: Jan. 25, 1994

[54] METHOD AND APPARATUS FOR CONNECTING CABLE TO THE SURFACE OF PRINTED CIRCUIT BOARDS OR THE LIKE

[75] Inventors: Edward G. Bundga, Endicott; Michael D. Dinardo, Owego; Jeffrey A. Knight, Endwell; Louis J. Konrad, III, Endicott, all of N.Y.

[73] Assignee: International Business Machines Corporation, Armonk, N.Y.

[21] Appl. No.: 767

[22] Filed: Jan. 5, 1993

[51] Int. Cl.[5] ..... H01R 23/68

[52] U.S. Cl. ..... 439/67; 439/108; 439/497

[58] Field of Search ..... 439/67, 493, 497, 108, 439/77, 92

[56] References Cited

U.S. PATENT DOCUMENTS

| | | | |
|---|---|---|---|
| 2,511,524 | 6/1950 | Adler . | |
| 2,511,806 | 6/1950 | Macy . | |
| 3,210,721 | 10/1965 | Dell . | |
| 3,211,822 | 10/1965 | Krall et al. . | |
| 3,315,218 | 4/1967 | Aker . | |
| 3,594,708 | 7/1971 | LaLonde . | |
| 3,851,294 | 11/1974 | Palazzetti et al. | 439/67 |
| 4,169,650 | 10/1979 | Schweizer . | |
| 4,790,775 | 12/1988 | David | 439/579 |
| 4,808,121 | 2/1989 | Smrekar | 439/394 |
| 4,812,601 | 3/1989 | Lothar | 439/485 |
| 4,861,284 | 8/1989 | Pauza et al. | 439/580 |
| 5,013,261 | 5/1991 | Seisz et al. | 439/581 |
| 5,061,192 | 10/1991 | Chapin et al. | 439/66 |
| 5,073,128 | 12/1991 | Sirai et al. | 439/585 |

FOREIGN PATENT DOCUMENTS 1121011 3/1982 Canada .

*Primary Examiner*—Gary F. Paumen

*Attorney, Agent, or Firm*—Calfee, Halter & Griswold

[57] ABSTRACT

A method and device are provided for connecting a triaxial or coaxial cable to a substrate by surface mount technology wherein the substrate has a plurality of contact pads located on the surface thereof. The connector includes a signal wire connector element connected to the signal wire of the cable and a drain wire connector element connected to each of the drain wires of the cable. The connection also includes resilient connector element, including a flexible circuit having a plurality of spaced electrical conducting lines thereon. One set of lines is for connection to the signal wires of the cable and the other set for connection to the drain wire(s) of the cable. The opposite ends of the signal line and drain line of the flexible circuit element are connected to electrical connection pads on the substrate to provide signal and drain connections between the cable and the substrate. A support element is configured and positioned to mount a plurality of the connectors on the substrate with the resilient element being resiliently urged into contact with the electrical connection pads on the substrate.

20 Claims, 7 Drawing Sheets

METHOD AND APPARATUS FOR CONNECTING CABLE TO THE SURFACE OF PRINTED CIRCUIT BOARDS OR THE LIKE

FIELD OF THE INVENTION

This invention relates generally to electrical interconnection of wire members to printed circuit boards or other similar type modules or substrates, and more particularly to the interconnection of coaxial or triaxial cables to printed circuit boards or the like using surface mount technology.

BACKGROUND ART

The current trend in the design of external electrical connections to circuit boards is to surface mount technology with increased densities of these connections. This trend toward high density connections is necessitated by virtue of the fact that circuit boards and the like have an ever increasing number of circuits and functions which must be connected externally, thus requiring an increased number of connections on the board; hence, a higher density of reliable connections or connectors is required in order to adequately service the various signal and other electrical requirements of the printed circuit boards.

In one type of circuit board environment, the connections are designed to bring signal lines and drain lines to the circuit board from coaxial or triaxial cables. In the past, these connections have typically taken the form of either soldered connections directly between the wires of the cables and pads on the boards or compliant pins inserted into holes in the circuit board or circuit card (pin-in-hole). In the case of pin-in-hole connections, these have tied up valuable internal wiring planes as well as necessitating relatively wide spacing between adjacent connections, thus limiting the density of connections that can be made on the surface of the card or board. In the case of soldered connections, these also require significant spacing between connections, as well as requiring very accurate solder joints, all precisely placed and well made. These joints are also subject to failure due to stress on the cables.

SUMMARY OF THE INVENTION

According to the present invention, a method and device are provided for connecting a triaxial or coaxial cable to a substrate by surface mount technology wherein the substrate has a plurality of contact pads located on the surface thereof. The connector includes a signal wire connector element connected to the signal wire of the cable and a drain wire connector element connected to each of the drain wires of the cable. The connection also includes resilient connector element, including a flexible circuit having a plurality of spaced electrical conducting lines thereon. One set of lines is for connection to the signal wires of the cable and the other set for connection to the drain wire(s) of the cable. The signal wire of each cable is secured to a signal line connector element, which in turn is connected to one end of a signal line on the resilient connector element. The drain wire(s) of each cable are connected to a drain wire connector element which in turn is connected to one end of a drain line on the resilient connector element. The opposite ends of the signal line and drain line of the flexible circuit element are connected to electrical connection pads on the substrate to provide signal and drain connections between the cable and the substrate. A support element is configured and positioned to mount a plurality of the connectors on the substrate with the resilient element being resiliently urged into contact with the electrical connection pads on the substrate. Preferably, the connector includes encapsulation of the connection between the flexible circuit element and the signal wire and drain wire connector elements to provide a plurality of in-line cable connector connections. These in-line cable connections are mounted in a housing to provide an array of the connected wires engaging the substrate. Connection of the cables can be made to either one side or both sides of the substrate. The connections and housing also provide strain relief from the connections to the substrate.

DESCRIPTION OF THE PREFERRED EMBODIMENTS

According to the present invention, an improved connector and assembly technique therefor is provided for connecting either coaxial or triaxial cables to printed circuit boards or other substrates utilizing flexible circuits and surface mount technology rather than pin-in-hole or direct wired interconnections. The improved cable connection of this invention provides a significantly increased density capability of reliable cable connections over prior art techniques, which increased density is required as the technology advances. This technique also allows for compliant strain relief as well as a positive resilient interconnection which permits some tolerance variations in spacing of the connector from the circuit board.

Figure 1:
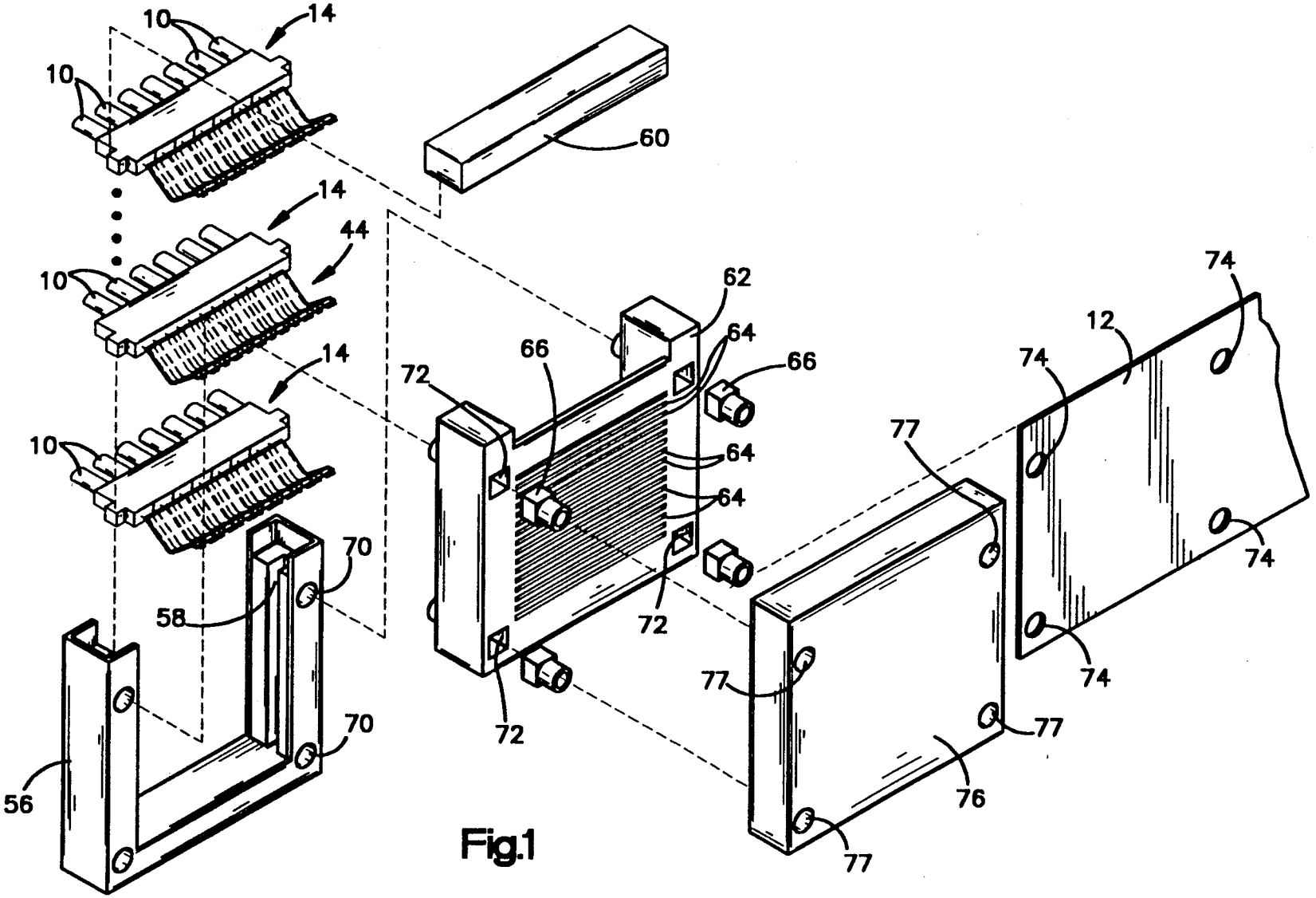
FIG. 1 is an exploded perspective view of triaxial cable connected to one side of a printed circuit board according to this invention.
Figure 1A:
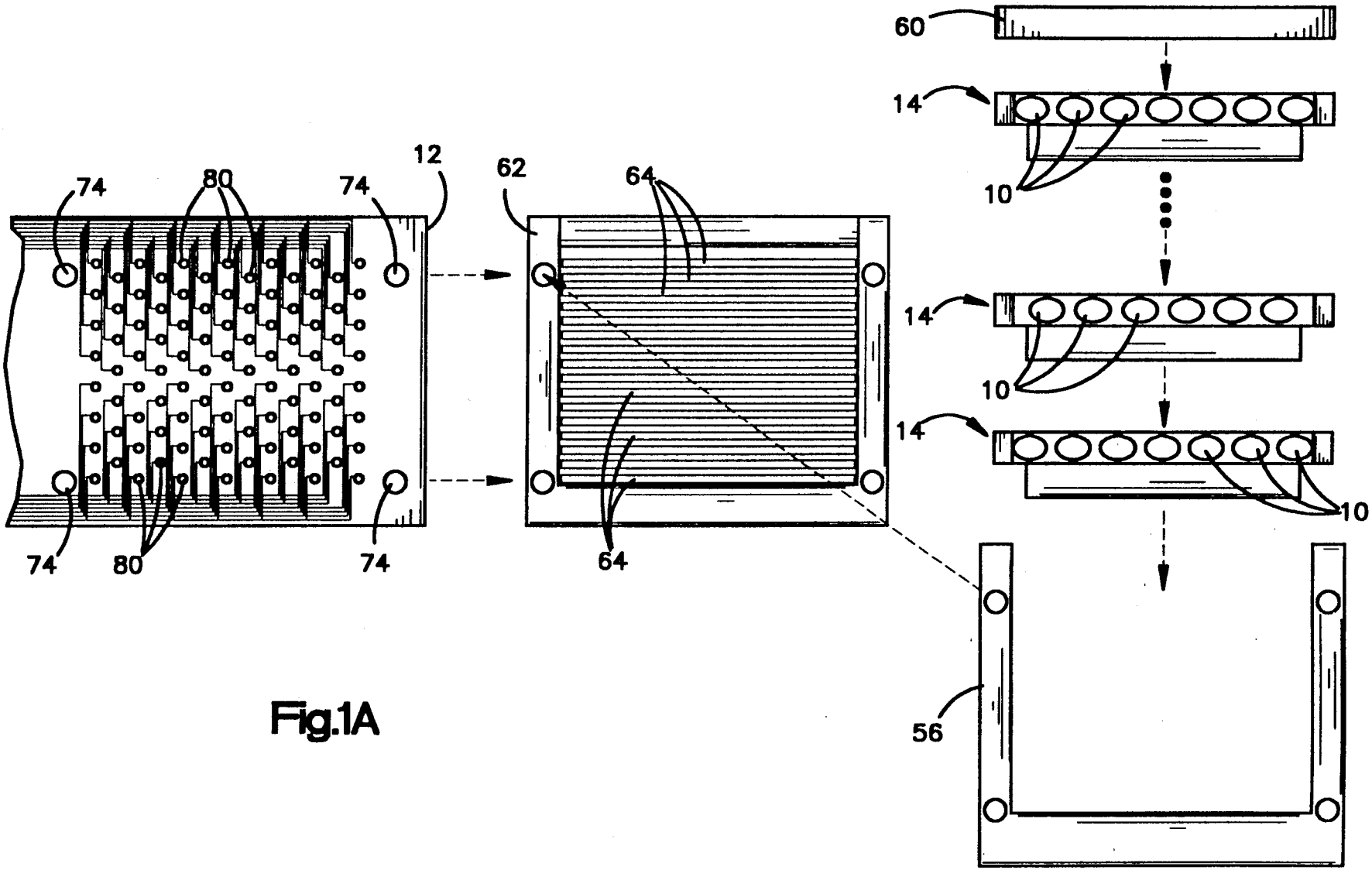
FIG. 1A is an exploded detailed front elevational view of the connection of some the connectors to the circuit board.
Figure 4:
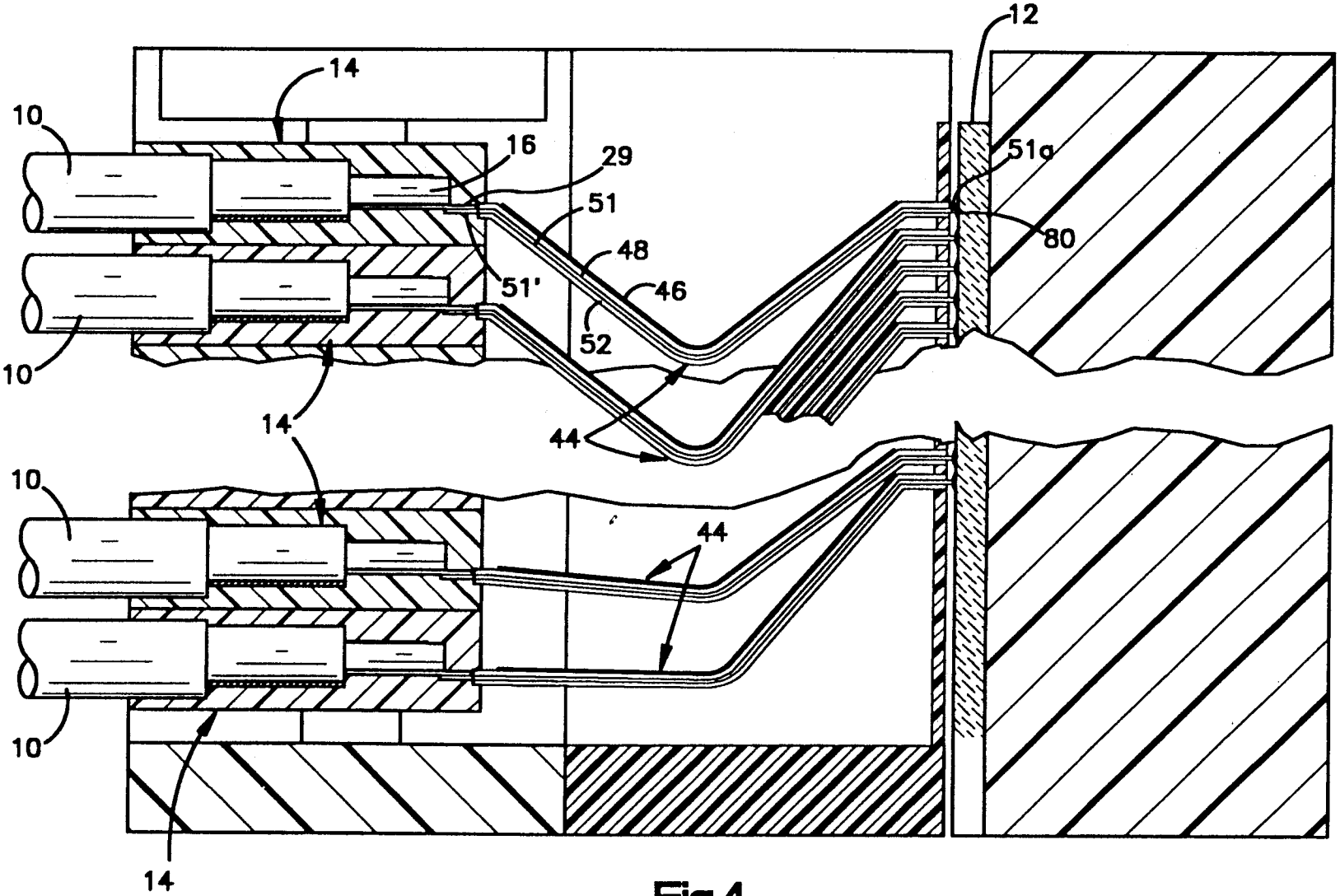
FIG. 4 is a longitudinal sectional view of several connector elements connected to the cable and circuit board utilizing a flexible circuit element.

Referring now to the drawings and for the present to FIGS. 1, 1A, and 4, these figures show generally the connection of a series of triaxial cables 10 to a printed circuit board 12 by surface mount technology utilizing connectors designated generally at 14 according to the present invention. The series of triaxial cables 10 are arranged and configured by means of the connectors 14 to be in an array of several superposed groups of in-line cables. The technique of forming the connections according to the present invention allows for the connection of a large number of coaxial cables within a very small surface area on the surface of the printed circuit board 12 thereby improving the achievable density required by the advances in surface mount technology.

Turning now more specifically to the connection of the cables, the preferred embodiment will be described as it is used as a connection for triaxial cables 10 which include a signal wire 16 surrounded by insulation 18 and a pair of drain wires 20 disposed on opposite sides of the insulation 18 all of which are covered by an outer insulator 22 (See FIG. 3). (It is to be understood, however, that the invention is equally applicable with only slight modifications to connections for a coaxial cable 10' with a signal wire 16' surrounded by insulation 18' which in turn is surrounded by a braided configuration of a single drain "wire" 20' as shown in FIG. 3A.)

Referring again to FIG. 3, to form the triaxial cable connection of the present invention a signal wire connector element 24 and a drain wire connector element 26 are each provided. The signal wire connector element 24 has a wire receiving cup 28 with an end lead 29 of a generally flat configuration extending therefrom. The drain wire connector element 26 includes a cable receiving portion 30 with a pair of curved edge tabs 31 and 32 and a finger 33. The finger 33 engages and is welded or soldered to an extension element 34 similar in configuration to the signal wire connector element 24, and which has a cupped portion 35 and a flat end portion 36.

Figure 2:
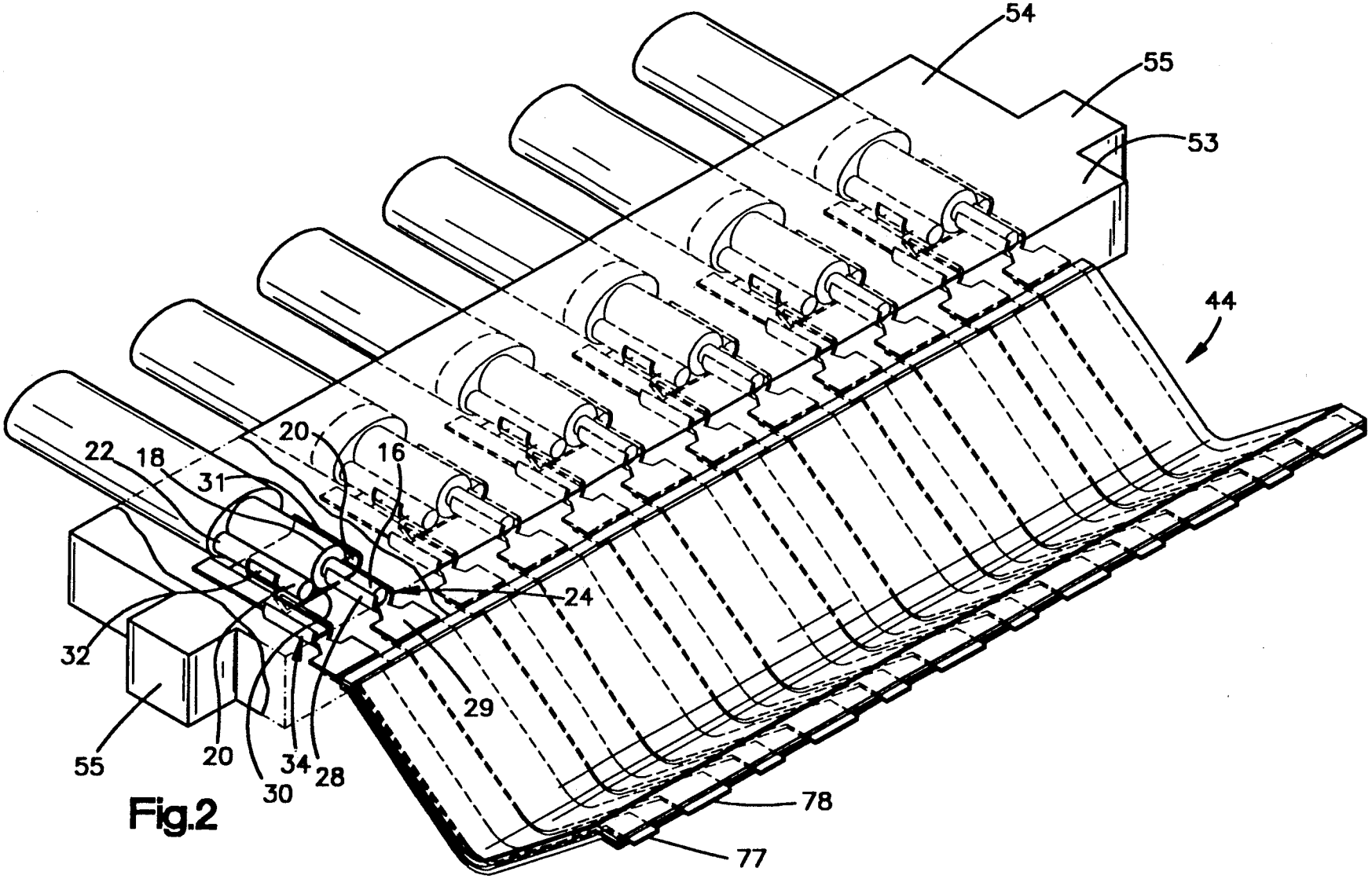
FIG. 2 is a detailed perspective view of encapsulated signal line connector elements and ground line connector elements connected to several triaxial cables and to a flexible circuit element to form a connector of this invention.

The signal wire connector elements 24 and drain wire connector elements 26 which are formed of a good electrical conductor such as copper, are connected to the triaxial cable as shown in FIG. 2. As shown in this FIG. 2 and in FIG. 3, the triaxial cable is stripped and prepared such that signal wire 16 is exposed extending from its insulation 18; and the outer insulation 22 is stripped further back revealing the two drain wires 20 disposed on opposite sides of the insulation 18. The drain wires are trimmed to terminate at the end of the exposed insulation 18. The end of the signal wire 16 is secured in the wire receiving cup 28 by welding or soldering to provide a solid mechanical and electrical connection. Additionally, the insulated signal wire 16 and the two drain wires 20 are seated in the cable receiving portion 30 of the drain wire connector element 26 with the curved edge tabs 31 and 32 engaging the drain wires 20. The drain wires 20 are also soldered or welded to the tabs 31 and 32 to provide solid mechanical and electrical connections therebetween. The fingers 33 are in turn welded or soldered to the extension elements 34 to thereby present flat connection surfaces 36. The surfaces 29 and 36 are generally aligned and coplanar.

Figures 3, 3A:
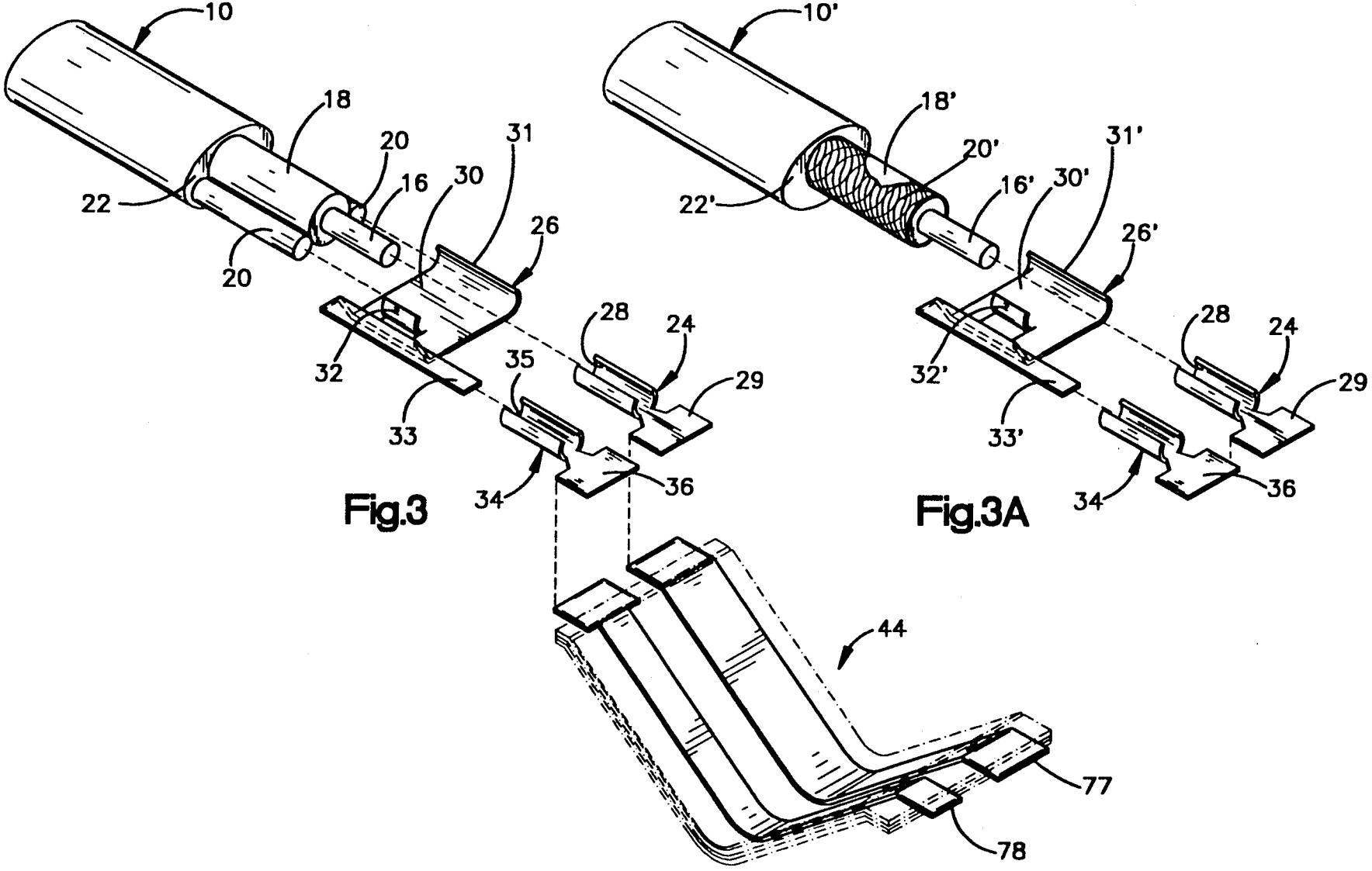
FIG. 3 is a perspective exploded view of the signal line and drain line connector elements showing how they are connected to a triaxial cable and to the ends of the lines of a flexible circuit element.
FIG. 3A is a detailed perspective exploded view of the connection of signal wire connection element and drain wire connection element to a coaxial cable.

When the invention is used with coaxial cable as shown in FIG. 3A. A drain wire connector element 26' is used which is very similar to the element 26 shown in FIG. 3 except that it has some modification of its curvature of its cable receiving portion 30' and edge tabs 31' and 32' are spaced to engage the braided drain wire 20'. Finger 33' is essentially the same as finger 33 of FIG. 3. Signal were connector element 24 and extension element 34 of FIG. 3A are both the same as that for triaxial cable as shown in FIG. 3.

Figure 5:
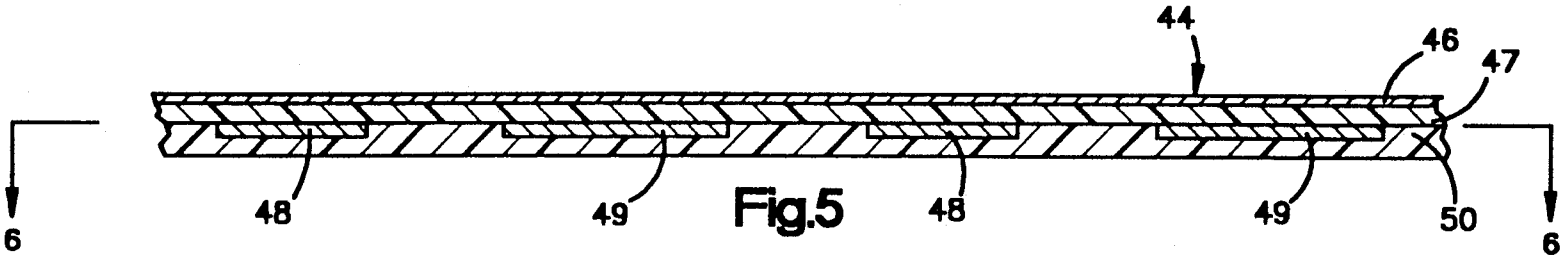
FIG. 5 is an enlarged sectional view of the resilient flexible circuit element.
Figure 6:
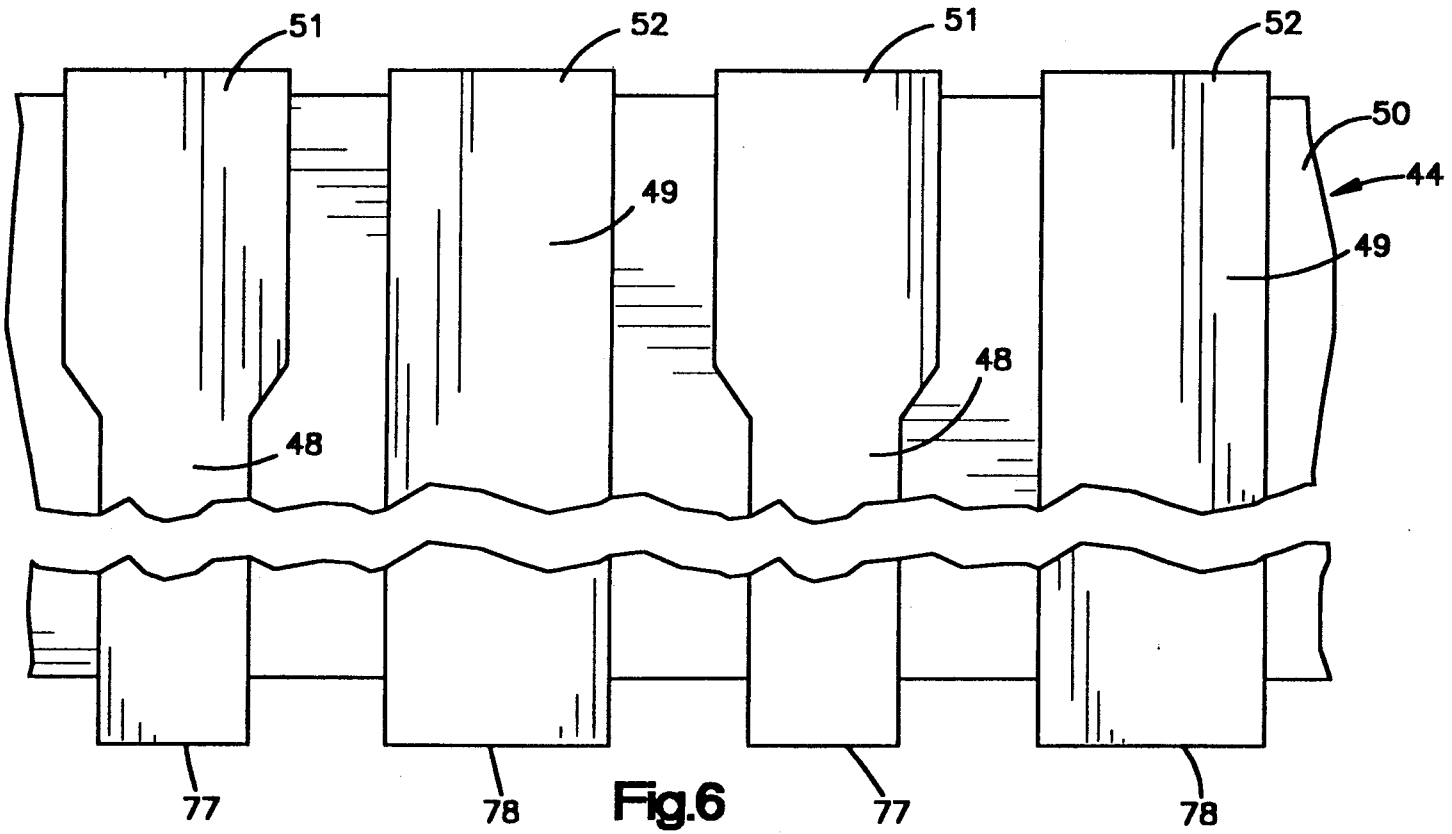
FIG. 6 is a sectional view taken substantially along the plane designated by the line 6—6 of FIG. 5.

Referring to FIG. 2, 3 and 4 signal wire elements 24 and 26 are connected to a resilient connector element 44. The resilient connector element 44, as shown in FIGS. 5 and 6 is comprised of a spring element 46 which in the preferred embodiment is made of a strip or sheet of spring-tempered beryllium copper and formed to the configuration shown in FIGS. 1, 1A, 2 and 4. Laminated to one side of the beryllium copper 46 is a flexible circuit element comprised of a dielectric polyamide 47 with longitudinally extending parallel electrically conducting circuit lines 48 and 49 formed thereon. The circuit lines 48 are for connection to the signal line connector element 24 and the circuit lines 49 are for connection to the extension element 34 of the drain wire connector element 26. To prevent electrical shorting, an overcoating of a dielectric polyethylene material 50 is laminated over the circuit lines 48 and 49.

Ends 51, 52 of the circuit lines 48, 49 are connected respectively to ends 30 of the signal wire connecting elements 24 and the ends 36 of element 34 of drain wire connection element 26, preferably by welding or soldering. Thus, all of cables 10 connected to a given flexible connector element 44 are aligned in a row. Typically, and as shown in FIG. 6, the signal wire lines 48 taper from the ends 51 since they do not require as much current carrying capacity as the drain line connection 49.

Each group of the triaxial cable wires with the signal wire connector elements 24 and drain wire connector elements 26 mounted thereto and secured to a given resilient connector element 44 are then molded into an encapsulant material 53 which encapsulates all of the connector elements 24, 26 as well as those connections to the cable wires 20, 22 and the flexible circuit conductors 48, 49 to provide mounting structures for each group of cables 10 as shown in FIGS. 1 and 2. This encapsulant is a dielectric plastic e.g. a liquid crystal polymer or poly phenyl surface such as Ryton manufactured by Phillips Petroleum Co. As shown in FIGS. 1 and 4, groups of these encapsulated wires are stacked in superposed relationship to form the connection of a group of cables to the circuit board. Further, it is preferred that the wires be staggered, and to this end in the preferred embodiment there are groups of 7 and 6 wires alternately in the stack as shown in FIGS. 1 and 1A.

The encapsulant 53 of each set of wires is molded with a generally rectilinear central portion 54 having a pair of ears 55 extending on opposite sides thereof which are shaped to fit into a housing element 56 as will be described presently. Thus, as can be seen in FIGS. 1 and 1A, alternating rows of 6 and 7 triaxial cables are provided, each of which cables is connected to a flexible circuit, with the connection being encapsulated in a dielectric plastic which will hold them firmly in place.

In order to connect the cables to the surface of the printed circuit board, the encapsulated cables are stacked in an array as shown in FIGS. 1, 1A, and 4 in the housing 56 having elongated channels 58 on opposite sides thereon in which the ears 55 of the encapsulant 53 reside to present an array of in-line groups of cables secured in the housing 56. A cover 60 is secured to the top of the housing 56 by an adhesive (not shown) and retains the arrayed cables therein.

An alignment member 62 is provided adjacent to the housing 56 and has a plurality of laterally extending alignment slots 64 formed therein through which each of the resilient connector elements 44 extend. The housing 56 and alignment member 62 are secured to the circuit board 12 by means of bolts 66 which extend through openings 70 in the housing and openings 72 in the alignment member and openings 74 in the printed circuit board. Additionally, a stiffener 76 is provided on the opposite side of the circuit board having openings 77 through which the bolts 66 also pass. Nuts (not shown) are threaded on the ends of the bolts 66 tightening the housing 56 and alignment member 62 and stiffener 76 tightly against the printed circuit board 12 with the stiffener 76 providing any additional rigidity which is necessary.

Figure 4A:
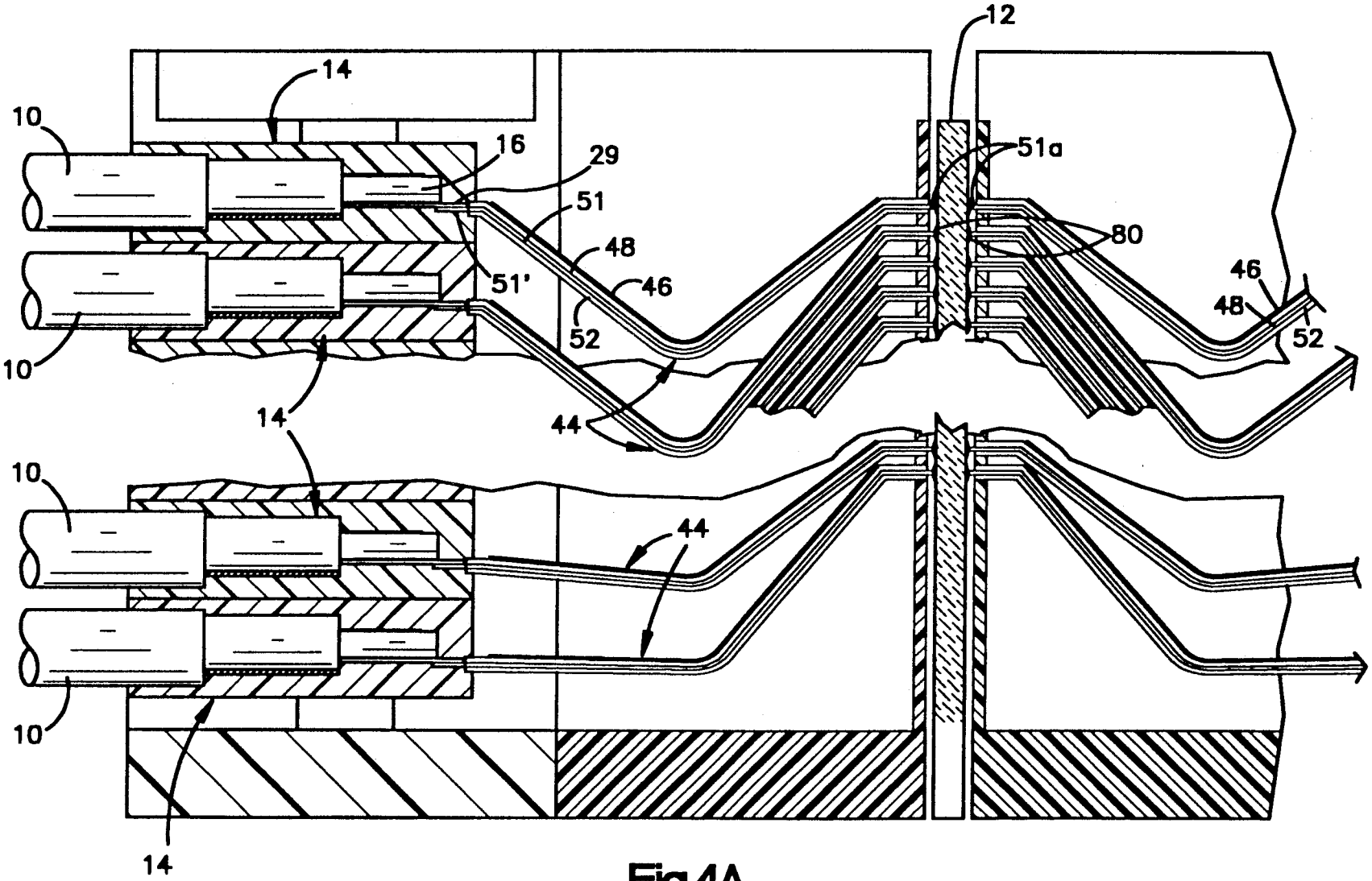
FIG. 4A is similar to FIG. 4 showing connections to both sides of the substrate.

If connections are to be made of cable to both sides of the circuit board 10, the stiffener 76 may be omitted and a similar array of cables connected on the opposite side of the printed circuit board by means of a second housing 56 and second alignment member 62 in a manner shown in FIG. 4A.

Ends 77, 78 of the circuit lines 48 and 49 on the flexible circuit opposite the ends 51, 52 extend past the end of the polyamide 47 and copper sheet 46 and contact electrical pads 80 formed on the surface of the printed circuit board 12 as shown in FIGS. 1A and 4. The spring-like nature of the resilient connector element 44 as it is mounted in the housing 56 causes the ends 77, 78 of the circuit lines 48 and 49 to be biased firmly into engagement with the pads 80 on the printed circuit board. This also permits a certain amount of manufacturing and assembly tolerance with respect to the spacing of the housing and the circuit board during assembly. This connection can be made more secure, if desired, by soldering if rework is not desired or by more recent dendritic type connections such as is shown in Canadian Patent No. 1,121,011, issued Mar. 30, 1982 to R. Babuka et al. entitled "Dendritic Electrical Contacts and Connectors". Such dendritic connections allow for easy rework by permitting the contacts to be separated for whatever rework is required then reconnected to the pads.

Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A connector for connecting a plurality of cables each having at least one signal wire and at least one drain wire to one surface of a substrate wherein said substrate has a plurality of contact pads formed on said one surface thereof, comprising:

a signal wire connector element connected to each signal wire and a drain wire connector element connected to each drain wire, respectively;

a resilient flexible connector element having first and second sets of spaced electrical lines thereon, each of the lines of said first set of electrical lines being connected at one end thereof to a respective said signal wire connector element and each of the lines of said second set of electrical lines being connected at one end to a respective said drain wire connector element;

the opposite ends of said first and second sets of lines contacting the pads on said substrate to provide signal wire and drain wire connections between said cable and said substrate; and a support element disposed to mount said connector on such substrate with said resilient element being urged toward said substrate.

2. The connector as defined in claim 1 wherein said connector includes a mounting structure for each group of cables connected to said resilient flexible connector element, and said support element includes a housing member mounted on said substrate to secure said mounting structures therein.

3. The connector as defined in claim 2 wherein said housing member and said mounting structures are configured and interconnected to isolate stress applied to said cables from the contact locations of the resilient flexible connecting element to the pads on the substrate.

4. The connector as defined in claim 2 wherein said mounting structure includes a dielectric material encapsulating said signal wire connector elements and said drain wire connector elements and their connections to the signal wires and drain wires and their connections to the electrical lines on the flexible connector element.

5. The connector as defined in claim 2 wherein said support element includes means to support a plurality of said mounting structures and their respective resilient flexible connector elements in superposed relationship.

6. The connector as defined in claim 5 further including an alignment member interposed between said housing member and said substrate to maintain the resilient flexible connector elements in separated relationship.

7. The connector as defined in claim 1 wherein said resilient flexible connector element includes a spring element normally urging said resilient flexible connector element toward said substrate.

8. The connector as defined in claim 5 further characterized by said alignment member includes a plurality of parallel slots through which said flexible connector elements extend.

9. The connector as defined in claim 1 further characterized by a stiffener member mounted to said substrate.

10. The structure as defined in claim 1 further characterized by a second connector connecting a second set of cables to pads on a second face of said substrate.

11. The connector as defined in claim 1 wherein said signal wire connector elements include a signal line engaging portion having a flat configuration connected to said electrical lines on said flexible connector element.

12. The connector as defined in claim 1 where said drain wire connector elements include a flat configuration connected to said electrical lines on said flexible connector element.

13. The invention as defined in claim I wherein said opposite ends of said first and second sets of lines contacting the pads on the substrate are connected to said pads by dendritic connections.

14. A method of connecting a plurality of cables each having at least one signal wire and at least one drain wire to a surface of a substrate wherein said substrate has a plurality of contact pads formed on said surface thereof, comprising the steps of:

providing a signal wire connector element and a drain wire connector element for each signal wire and drain wire, respectively;

connecting said signal line connector elements to the signal wires and said drain line connector elements to the drain wires;

providing a resilient flexible connector element having first and second sets of spaced electrical lines thereon;

connecting each of the lines of said first set of electrical lines at one end thereof to a signal wire connector element, and connecting each of the lines of said second set of electrical lines at one end to a drain wire connector element;

providing support element adjacent said surface of said substrate;

mounting said connector elements in said support element with the opposite ends of said first and second sets of lines resiliently contacting the pads on said substrate;

whereby to provide signal wire and drain wire connections between said cable and said substrate.

15. The method as defined in claim 14 further characterized by mounting groups of said connectors in a mounting structures and said support element includes a housing member mounted on such substrate, and secure said mounting structures in said housing.

16. The method as defined in claim 15 wherein said housing member and said mounting structures are configured and interconnected to isolate stress applied to said cables from the contact locations of the resilient flexible connector element to the pads on the substrate.

17. The method as defined in claim 14 further characterized by arranged said mounting structures and their respective resilient flexible connector elements in superposed relationship in said housing member.

18. The method as defined in claim 17 further including an alignment member interposed between said housing member and said substrate to maintain the resilient flexible connector elements in separated relationship.

19. The method as defined in claim 18 further characterized by providing said alignment member with a plurality of slots, and wherein said flexible connector elements are extended through said slots.

20. The invention as defined in claim 14 wherein the opposite ends of said first and second sets of lines contacting the pads are connected to said pads by dendritic connections.

* * * * *

UNITED STATES PATENT AND TRADEMARK OFFICE

CERTIFICATE OF CORRECTION

PATENT NO. : 5,281,150

DATED : January 25, 1994

INVENTOR(S) : Bundga, et al.

It is certified that error appears in the above-identified patent and that said Letters Patent is hereby corrected as shown below:

Column 6, line 37, add --said-- after "second" (second occurrence)

Column 6, line 48, claim [I] should read --claim 1--

Column 6, line 67, add --respective-- after to a

Column 7, line 1, add --respective-- after"to a"

Column 7, line 3, add --a-- after "providing"

Column 7, line 12, delete [a]

Signed and Sealed this

Thirty-first Day of May, 1994

Bruce Lehman

*Attest:*

BRUCE LEHMAN

*Attesting Officer*

*Commissioner of Patents and Trademarks*